United States Patent [19]

Yamada

[11] Patent Number: 4,968,038

[45] Date of Patent: Nov. 6, 1990

[54] LARGE-SIZED TWO PIECE SOLID GOLF BALL

[75] Inventor: Mikio Yamada, Kobe, Japan

[73] Assignee: Sumitomo Rubber Industries, Ltd., Kobe, Japan

[21] Appl. No.: 293,590

[22] Filed: Jan. 3, 1989

Related U.S. Application Data

[63] Continuation of Ser. No. 947,246, Dec. 29, 1986, abandoned, which is a continuation of Ser. No. 531,559, Sep. 13, 1983, abandoned.

[30] Foreign Application Priority Data

Sep. 13, 1982 [JP] Japan ..... 57-160564

[51] Int. Cl.[5] ..... A63B 37/14

[52] U.S. Cl. ..... 273/232; 273/DIG. 022; 273/235 R; 273/62; 273/220; 273/218

[58] Field of Search ..... 273/232, 62, 220, 235 R, 273/DIG. 022, 230, 218

[56] References Cited

U.S. PATENT DOCUMENTS

| | | | |
|---|---|---|---|
| 878,254 | 2/1908 | Taylor | 273/218 |
| 4,090,716 | 5/1978 | Martin et al. | 273/232 |
| 4,141,559 | 2/1979 | Melvin et al. | 273/232 |
| 4,142,727 | 3/1979 | Shaw et al. | 273/232 |
| 4,272,079 | 6/1981 | Nakade et al. | 273/235 R |
| 4,323,247 | 4/1982 | Keches et al. | 273/235 R |
| 4,720,111 | 1/1988 | Yamada | 273/232 |

FOREIGN PATENT DOCUMENTS

| | | | |
|---|---|---|---|
| 967188 | 5/1975 | Canada | 273/232 |

OTHER PUBLICATIONS

"The Curious History of the Golf Ball, Mankind's Most Fascinating Sphere", John Stuart Martin, Horizon Press, N.Y., 1968, pp. 127–130.

*Primary Examiner*—George J. Marlo

[57] ABSTRACT

A large-sized (1.68 inches) two piece solid golf ball superior in flight distance, comprising a solid core and a cover having a thickness of 2.10 to 2.30 mm. and a Shore D hardness of not less than 65, the total volume of dimples being from 330 to 365 mm$^3$.

6 Claims, 2 Drawing Sheets

LARGE-SIZED TWO PIECE SOLID GOLF BALL

This application is a continuation of application Ser. No. 947,246, filed Dec. 29, 1986, now abandoned, which is a continuation of application Ser. No. 531,559, filed Sept. 13, 1983, now abandoned.

BACKGROUND OF THE INVENTION

The present invention relates to a large-sized (1.68 inches) two piece golf ball, and more particularly to a large-sized two piece golf ball having a high impact resilience and an excellent flight characteristic.

Wound golf balls which have hitherto been widely employed, have the advantages of being high in impact resilience and of being high in initial velocity upon impact, but have the fatal defect that they are lacking in durability.

In order to improve the durability, two piece solid golf balls consisting of a solid core having a high impact resilience and a cover having an excellent cut resistance have been developed. However, such two piece solid golf balls are also not necessarily satisfactory for the present demands, and accordingly it is desired to further improve the performances of the golf balls.

SUMMARY OF THE INVENTION

The present inventor has found that a two piece solid golf ball having a high impact resilience and a large flight distance (carry) is obtained by a particular combination of a cover material, i.e. cover hardness, a cover structure, i.e. cover thickness, and a total dimple volume.

In accordance with the present invention, there is provided a large-sized two piece solid golf ball comprising a solid core and a cover for covering the solid core, said cover having a thickness of 2.10 to 2.30 mm., a Shore D hardness of not less than 65 and dimples whose total volume is from 330 to 365 $mm^3$.

DETAILED DESCRIPTION

Figure 1:
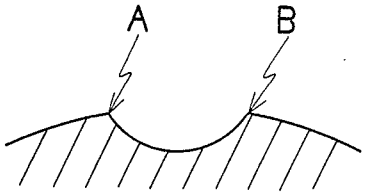
FIGS. 1 and 2 are illustrative views for making it easy to understand a method for measuring a total volume of dimples.
Figure 2:
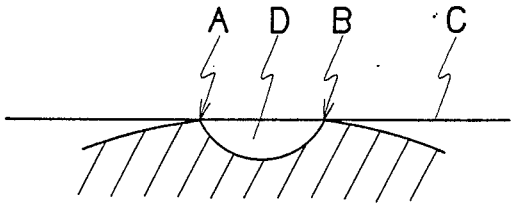
Figure 3:
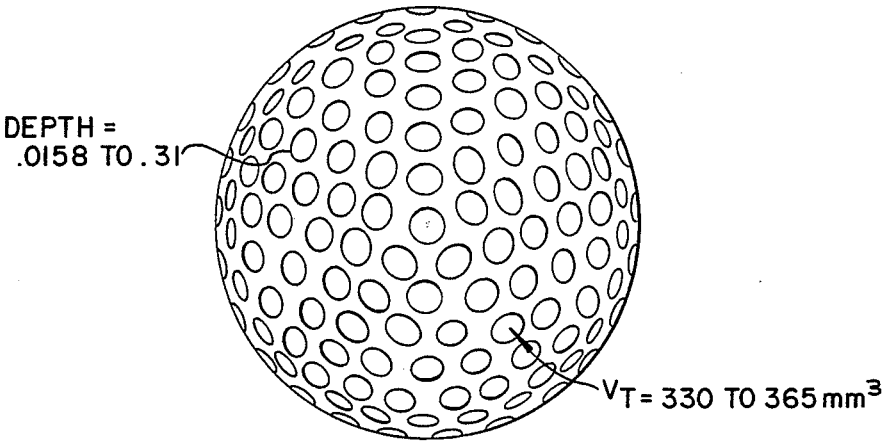
FIG. 3 is a front exterior view of a golf ball in accordance with the present invention.
Figure 4:
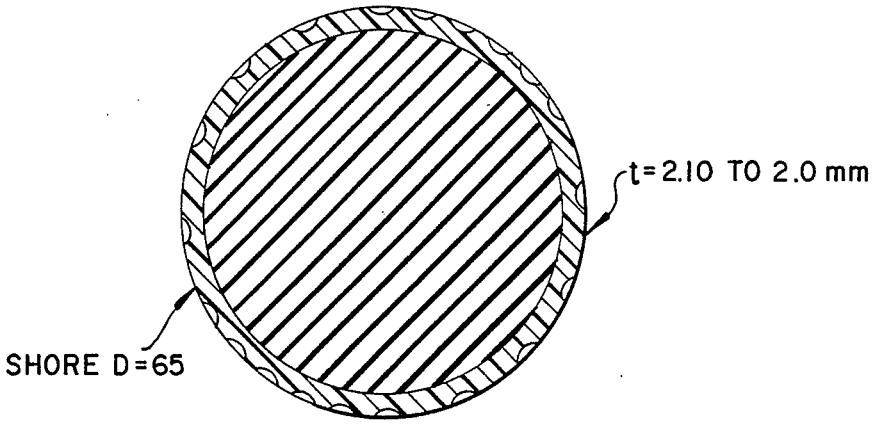
FIG. 4 is a cross-sectional view thereof.

The hardness of a cover exerts an influence particularly on the impact resilience. It is necessary that the cover has a Shore D hardness of not less than 65. When the Shore D hardness is less than 65, the impact resilience of the golf ball is lowered. The thickness of the cover and the total valume of dimples exert an influence particularly on the carry of the golf ball. It is necessary that the thickness of the cover is from 2.10 to 2.30 mm., preferably 2.10 to 2.20 mm., and that the total volume of dimples is from 330 to 365 $mm^3$., preferably 345 to 360 $mm^3$. When the cover thickness is less than 2.10 mm., the durability becomes very bad, and when the cover thickness is more than 2.30 mm., the diameter of the core must be made small and accordingly the impact resilience is lowered. Also, when the total volume of dimples is less than 330 $mm^3$., the trajectory of the ball becomes high, thus the ball rather does not fly well due to hopping. In contrast with this, when the total volume of dimples is more than 365 $mm^3$., the trajectory of the ball becomes low, thus the carry is decreased. In particular, desirable results are obtained when the cover has a Shore D hardness of not less than 65 and a thickness of 2.10 to 2.20 mm. and the total volume of dimples is from 345 to 360 $mm^3$.

The thickness of the cover as herein shown is an average thickness obtained by arbitrarily selecting three portions of the cover where no dimple is present, measuring the thickness of the portions by an ultrasonic thickness gauge, etc. and averaging the three values.

The total volume of dimples as herein shown is one obtained by arbitrarily selecting 8 or 16 dimples from among about 340 dimples, measuring the volume of the dimples by a surface configuration measuring instrument and calculating the total volume of dimples by a rule-of-three sum. The measurement of the volume of a dimple is made as follows: A dimple is cut along the diameter of the opening of the dimple, and a chart of the dimple as shown in FIG. 1 extending from one end A to another end B is obtained by tracing the bottom of the dimple at the section with a pick-up type surface configuration measuring instrument. The volume of portion D enclosed by the bottom of the dimple and plane C is obtained by calculation on the basis of the chart.

As a cover of the golf ball of the present invention, there is preferably employed a cover composition comprising an ionomer resin, polyurethane, polyamide, or polyacetal as a main component, into which an inorganic filler, e.g. titanium dioxide and zinc oxide, may be incorporated for the purpose of coloring or the like, as occasion demands. The use if ionomer resins, e.g. ionomer resins sold under the trademark "Surlyn" by the E. I. Dupont de Nemours Company, is particularly preferred, since the cut resistance is excellent. Additives such as antioxidants and stabilizers may also be added.

A preferable composition for preparing a solid core of the golf ball of the invention is a composition comprising cis-1,4-butadiene rubber, 20 to 60 parts by weight of an acrylic or methacrylic acid salt, 10 to 30 parts by weight of zinc oxide and 0.5 to 5 parts by weight of a peroxide such as dicumyl peroxide, respectively, per 100 parts by weight of the rubber. The core is prepared by heat pressure molding the composition into a sphere, the diameter of which is selected from 36 to 39 mm. in accordance with the thickness of the cover.

A method for covering the solid core with a cover material is not particularly limited, and known methods are adoptable. Usually, the solid core is covered with two covers previously molded in the form of a hemispherical shell, and it is then pressure molded to fuse two hemispherical shells together and to form dimples. A method in which a cover composition is injection molded directly around the solid core is also adoptable.

The present invention is more specifically described and explained by means of the following Examples, in which all parts are by weight.

It is to be understood that the present invention is not limited to the Examples, and various changes and modifications may be made in the invention without departing from the spirit and scope thereof.

EXAMPLES 1 TO 7 AND COMPARATIVE EXAMPLES 1 TO 5

The following experiments were made to examine the influence of the cover hardness on the initial velocity of a golf ball.

A core composition (I) shown in Table 1 was cured in a mold at 160° C. for 30 minutes (heat pressure molding) to give solid cores having a diameter of 38.2 mm.

TABLE 1

| | Composition (part) | |
|---|---|---|
| | I | II |
| Cis-1,4-butadiene rubber | 100 | 100 |
| Zinc dimethacrylate | 30 | 30 |
| Zinc oxide | 20 | 18 |
| Dicumyl peroxide | 2.5 | 2.5 |

Two half shells of a cover formed from a cover composition shown in Table 2 were positioned around each solid core, and subjected to pressure molding in a mold for a golf ball at 170° C. for 2 minutes to give a two piece solid golf ball having a diameter of 42.8 mm.

The properties of the obtained golf balls are shown in Table 2.

In the Examples, the initial velocity of the golf ball was measured with respect to a ball struck with a wood No. 1 golf club (driver) at a head speed of 45 m./sec. by a swing machine (swing robot made by True Temper Co., Ltd.).

TABLE 2

| Run No. | 1 | 2 | 3 | 4 |
|---|---|---|---|---|
| Cover composition (part) | | | | |
| Surlyn* 1707 | 100 | — | — | 30 |
| Surlyn 1605 | — | 80 | 20 | — |
| Surlyn 1652 | — | 20 | 80 | — |
| Surlyn 1601 | — | — | — | 70 |
| Titanium dioxide | 1 | 1 | 1 | 1 |
| Shore D hardness of cover | 67 | 65 | 64 | 63 |
| Weight of ball (g.) | 45.1 | 45.1 | 45.2 | 45.1 |
| Hardness of ball (PGA system) | 100 | 99 | 98 | 97 |
| Initial velocity of ball (m./sec.) | 64.8 | 64.6 | 63.9 | 63.5 |
| Modulus of elasticity in bending of cover (kg./cm.$^2$)(ASTM D-790) | 3,850 | 3,410 | 3,050 | 3,010 |

*Trademark of an ionomer resin made by E. I. DuPont de Nemours Co.

As shown in Table 2, the initial velocity of a ball is large when the Shore D hardness of the cover is not less than 65. The reason is considered to be that in case of a two piece golf ball, the larger the hardness of a cover, the modulus of elasticity in bending of the cover tends to become larger, thus the larger the effect of preventing the deformation of the ball at the time of striking the ball.

Large-sized two piece solid golf balls having varied cover thicknesses and total dimple volumes and having a constant cover hardness (Shore D hardness of the cover: 67) were prepared in the same manner as above by employing a core composition (I) or (II) shown in Table 1 and a cover composition used in Run No. 1 of Table 2.

The properties of the golf balls are shown in Table 3.

It is observed in Table 3 that a particular combination of the cover hardness, cover thickness and total dimple volume provides a golf ball having an excellent flight characteristic.

In addition to the ingredients used in the Examples, other ingredients can be used in the Examples as set forth in the specification to obtain substantially the same results.

TABLE 3

| | Ex. 1 | Ex. 2 | Ex. 3 | Ex. 4 | Ex. 5 | Ex. 6 | Ex. 7 | Com. Ex. 1 | Com. Ex. 2 | Com. Ex. 3 | Com. Ex. 4 | Com. Ex. 5 |
|---|---|---|---|---|---|---|---|---|---|---|---|---|
| Core composition | II | II | II | II | II | II | II | I | II | II | II | II |
| Thickness of cover (mm.) | 2.12 | 2.26 | 2.12 | 2.26 | 2.20 | 2.20 | 2.20 | 2.40 | 1.95 | 2.12 | 2.12 | 2.20 |
| Total volume of dimples (mm.$^3$) | 330 | 330 | 365 | 355 | 338 | 345 | 360 | 355 | 355 | 320 | 375 | 300 |
| Weight of ball (g.) | 45.3 | 45.1 | 45.2 | 45.0 | 45.1 | 45.1 | 45.1 | 44.8 | 45.4 | 45.2 | 45.1 | 45.2 |
| Hardness of ball (PGA system) | 99 | 99 | 100 | 99 | 100 | 100 | 100 | 101 | 98 | 100 | 99 | 100 |
| Initial velocity (m./sec.) | 64.8 | 64.7 | 64.8 | 64.6 | 64.7 | 64.7 | 64.8 | 64.7 | 64.7 | 64.8 | 64.8 | 64.8 |
| Carry (m.) | 197.3 | 197.8 | 198.5 | 199.0 | 197.9 | 199.3 | 199.4 | 191.0 | 192.1 | 193.3 | 185.9 | 189.8 |
| Total distance (m.) | 211.2 | 210.1 | 211.3 | 212.1 | 210.9 | 213.1 | 212.1 | 204.3 | 203.8 | 195.8 | 204.8 | 200.2 |

What is claimed is:

1. A two piece solid golf ball comprising a solid core and a cover for covering the solid core, said cover having a thickness of 2.10 to 2.30 mm, a Shore D hardness of not less than 65, and the outer periphery of said ball having a plurality of dimples formed therein, each of said dimples having the form of a circle in cross section, and the dimples having a diameter and a depth to provide a total dimple volume in the range of 330 to 365 mm$^3$.

2. A two piece solid golf ball comprising a solid core enclosed in a cover, said cover having an average thickness of 2.10 to 2.30 mm, a Shore D hardness of not less than 65, and a plurality of dimples in the outer periphery of the ball, said dimples having a cross section in the form of a circle, and a total dimple volume of 330 to 365 mm$^3$.

3. The golf ball of claim 1, wherein said cover comprises an ionomer resin.

4. The golf ball of claim 1, wherein said solid core is made of a rubber composition comprising cis-1,4-butadiene rubber.

5. The golf ball of claim 1, wherein said cover has a thickness of 2.10 to 2.20 mm.

6. The golf ball of claim 1, wherein the total volume of the dimples is from 345 to 350 mm$^3$.

* * * * *